US009260800B1

(12) United States Patent
Tao

(10) Patent No.: US 9,260,800 B1
(45) Date of Patent: Feb. 16, 2016

(54) MELT-BLOWING APPARATUS WITH IMPROVED PULLER DEVICE FOR PRODUCING TUBULAR NONWOVENS

(71) Applicant: Thomas M. Tao, Greer, SC (US)

(72) Inventor: Thomas M. Tao, Greer, SC (US)

( * ) Notice: Subject to any disclaimer, the term of this patent is extended or adjusted under 35 U.S.C. 154(b) by 0 days.

(21) Appl. No.: 14/614,383

(22) Filed: Feb. 4, 2015

(51) Int. Cl.

| | |
|---|---|
| ***D04H 1/56*** | (2006.01) |
| ***D04H 1/732*** | (2012.01) |
| ***D04H 1/76*** | (2012.01) |
| ***D01D 5/16*** | (2006.01) |
| ***D01D 5/098*** | (2006.01) |
| ***D01D 4/02*** | (2006.01) |
| ***D01D 7/00*** | (2006.01) |

(52) U.S. Cl.
CPC ..... *D01D 5/16* (2013.01); *D01D 4/025* (2013.01); *D01D 5/0985* (2013.01); *D01D 7/00* (2013.01); *D04H 1/565* (2013.01); *D04H 1/732* (2013.01); *D04H 1/76* (2013.01)

(58) Field of Classification Search
CPC ..... D01D 4/025; D01D 5/0985; D01D 5/16; D01D 7/00; D04H 1/565; D04H 1/732; D04H 1/76
See application file for complete search history.

(56) References Cited

U.S. PATENT DOCUMENTS

| | | | | |
|---|---|---|---|---|
| 3,639,958 | A * | 2/1972 | Griffiths | 492/50 |
| 3,825,380 | A | 7/1974 | Harding et al. | |
| 3,849,241 | A | 11/1974 | Butin et al. | |
| 3,905,734 | A * | 9/1975 | Blair | 425/224 |
| 4,116,159 | A | 9/1978 | Long | |
| 4,116,738 | A | 9/1978 | Pall | |
| 4,240,864 | A | 12/1980 | Lin | |
| 4,847,125 | A | 7/1989 | Schwarz | |
| 4,889,476 | A | 12/1989 | Buehning | |
| 5,336,576 | A | 8/1994 | Miyamoto et al. | |
| 5,366,576 | A * | 11/1994 | Clack | 156/173 |
| 5,409,642 | A | 4/1995 | Allen et al. | |
| 5,672,232 | A | 9/1997 | Clack | |
| 6,391,200 | B2 | 5/2002 | Pulek et al. | |
| 6,736,274 | B2 | 5/2004 | Tremblay et al. | |

* cited by examiner

*Primary Examiner* — Yogendra Gupta
*Assistant Examiner* — Joseph Leyson
(74) *Attorney, Agent, or Firm* — Charlotte C. Wilson

(57) ABSTRACT

This disclosure is related to the manufacture of melt blown coreless tubular nonwovens. Such manufacture includes a melt blowing apparatus to deposit fibers onto a rotating mandrel for forming a tubular nonwoven; a puller device to withdraw the tubular nonwoven from the mandrel; and a cutting device to cut the tubular nonwoven into cartridges of a desired length. The puller device has a pair of drive axles mounted on a gap-setting device, such as a scissor jack or its equivalent. Each drive axle includes one or more driven multi-directional puller wheels, which is formed of or surrounded by non-driven rollers. When the rollers engage the rotating tubular nonwoven, the tubular nonwoven is pulled axially and steadily from the mandrel without affecting the rotational motion of the tubular nonwoven. As a result, the tubular nonwovens have consistent dimensions and quality without damage to the inner or outer surfaces of the tube.

17 Claims, 10 Drawing Sheets

MELT-BLOWING APPARATUS WITH IMPROVED PULLER DEVICE FOR PRODUCING TUBULAR NONWOVENS

TECHNICAL FIELD

The present disclosure relates to a system and apparatus for making coreless nonwoven tubes for uses in filtration, irrigation, drainage, and the like. More particularly, an apparatus for the manufacture of the nonwoven tubular products by a process commonly known as "melt blowing" includes an improved puller device.

BACKGROUND

The term "melt blown" refers to fibers or a mat formed by extruding a molten thermoplastic material (the "melt" or the "polymer melt") through a plurality of fine orifices as molten filaments into converging flows of high-speed heated gas. This process is described more fully in U.S. Pat. No. 3,825,380; U.S. Pat. No. 3,849,241; and U.S. Pat. No. 4,889,476, all of which are incorporated by reference herein, as well as in numerous other publications. Generally speaking, the polymer is melted in an extruder and forced through a row of fine capillaries (also known as "orifices" or "nozzles" or "spinnerets") to produce molten filaments. The orifices are drilled through the apex of a sharp angled metal structure called the "die tip." Two adjacent parts known as "air plates" or "air blades" surround the die tip and define the gaps between them, which constitute the geometry of the "air knives".

High pressure and temperature air or gas (known as the "primary air") passes through the air knives. The pressure of the supplied primary air determines the blowing speed of the air knives. The air knives attenuate and agitate the molten filaments as they exit the orifices to reduce their diameters and to improve the molecular alignment of the polymer. By regulating the temperature and pressure of the primary air and those of the polymer melt, this arrangement is capable of producing fibers of different diameter sizes, from the submicron diameter range to macro fibers (with average diameters of greater than 40 microns). According to U.S. Pat. No. 3,825,380, the upper limit for the diameter of the melt blowing orifice is about 0.03 inches. Orifices of larger size may produce excessively large shots in the resulted nonwoven products. Melt-blown fibers are sufficiently continuous and self-bonding, when deposited onto a collecting surface.

One of the major uses of nonwoven fabrics or articles (often simply called "nonwovens") is for gas and liquid filtration. Melt-blown (MB) nonwovens are particularly suitable for such uses, because their micro-sized fibers and pores can trap even microscopic particles while still allowing flow to pass through the article. Melt-blown nonwovens meet stringent filtration requirements better than other nonwovens can, including spun bonded, air-laid, wet-laid, carded, needle-punched, and spun-laced nonwovens, as well as most glass or wood fiber mats.

In filtration applications, both planar mats and cylindrical tubular filters are common. The latter functions especially well in situations with tight space, large flow volume, or high flow pressure. The early tubular filters were made by rolling up nonwoven sheets and then cutting into a desired length. This method has been found to have some significant drawbacks.

First, this manufacturing approach requires numerous steps and pieces of equipment, including cutting off and recycling the two ends of the rolled-up tube. These discrete steps cannot be integrated into a continuous process flow. Predictably, the equipment, material, and labor costs are high. Additionally, the layered filter tubes have lower material utilization efficiency than that of a one-piece nonwoven tube of the same weight.

Secondly, the resulting rolled-up filter has deficiencies. For example, the layered tube has poor rigidity, and often requires a hard inner core to help withstand flow pressure. Incorporating such a core requires additional equipment, material, and costs. Moreover, seams are required to secure the inner and outer edges to the tube body, which can be problematic for some applications. Also, variations in the nonwoven sheets (such as variations in weight, thickness, porosity, and the like) result in variations in the final tubular product.

Lastly, this method is not suitable for making tubular filters with density-gradient walls, which are more popular in the industry due to their better filtration efficiency and longer service life.

Therefore, the filtration industry has enthusiastically pursued methods and equipment for making one-piece melt-blown (MB) tubes that are coreless and seamless. In this approach, a tubular nonwoven system 1 includes a melt-blowing die 101 that blows molten fibers 103 directly onto a rotating mandrel roll 102 to form a porous tubular nonwoven 104, as shown generically in FIG. 1. The distance between the die tip and the mandrel roll influences the tightness of the laid fibrous body. As the tube reaches the desired outer diameter, it is continuously withdrawn from the mandrel by a puller device 107 (as indicated by dashed lines, more details of which will be provided below). Downstream of the puller device 107, a motor-driven cutting device 105 (e.g., a flying knife or saw) is used to cut the moving tube 104 into nonwoven cartridges 106 of a desired length. The results are better products with low capital, labor, and waste.

Examples of such efforts to produce tubular melt-blown nonwovens may be found in U.S. Pat. No. 4,112,159; U.S. Pat. No. 4,116,738; U.S. Pat. No. 4,847,125; U.S. Pat. No. 5,366,576; U.S. Pat. No. 5,409,642; U.S. Pat. No. 5,591,335l; U.S. Pat. No. 5,672,232; U.S. Pat. No. 6,391,200; and U.S. Pat. No. 6,736,274. Some of these exemplary devices use a single die, while others use multiple dies.

It is well understood that there are numerous, sometimes conflicting, requirements to develop a satisfactory means of pulling the rotating tube off the mandrel continuously and steadily. Some of these requirements include:

a. The puller device should be economical to build, easy and safe to use.

b. The position and movement of the puller device should permit the safe and free movement of the tube-cutting knife or saw.

c. The puller device should be able to operate over a broad range of speeds and inner and outer tube diameters with quick and simple adaptation only, because tubular products are routinely made in many diameters, lengths, and wall thicknesses.

d. All melt-blown devices have a fluctuating and generally declining output rate, due to the gradual clogging of the melt filter, contamination of the nozzle, and possible fluctuation in the voltage received by the device. Therefore, the puller device's speed should be self-correcting or at least easily adjustable to maintain product consistency.

e. Physical damage to the inside or outside of the tubular cartridges should be avoided to preserve their functionality. Crushing, cuts, tears, scratches, punctures, fluid channeling, or loose fibers adversely affect the performance of the tubular cartridges. Cuts to the inside wall may be particularly destructive, as they cause filtrate leakage.

f. The rate of fiber mass being removed from the mandrel must match the rate of fiber deposition onto the mandrel, so that the resulting tube will have consistent weight and diameter. Slippage among the mandrel, the tube, and the puller device cannot be tolerated.

g. When the puller device pulls the tube off the mandrel, it must not fight against the rotational motion of the tube (as imparted by the mandrel). Rotational speed change or slippage between the tube and the mandrel may lead to uneven weight and dimension in the tubular cartridges, and such quality issues are difficult to detect and correct during production.

h. The puller device should maintain a firm and constant grip on the rotating tube, even as the latter's surface often has varied and changing properties including tube diameter, coefficient of friction, hardness, material's oily content, average fiber diameter, fuzziness, moisture, spray coatings, out-of-roundness, compaction treatment on tube wall, and the like. With conventional puller devices, tightening the grip is the only method of accommodating differences in nonwoven properties, which may interfere with the tube's rotational motion. Rotational retardation or slip, detectable or not, violates requirements "f" and "g" above.

i. To meet so many requirements simultaneously, the puller device's operation and control should be able to utilize modern automation technology to reduce manual labor and avoid errors and inaccuracy.

Currently, there are several types of puller devices in commercial use, which are widely apart in concept and design but none of which can be considered as satisfactory. The existing types of puller devices include devices with a rotating screw inside the tubular nonwoven; devices with rotating screws on the outside of the tubular nonwoven; devices with multiple canted rolls; devices with gears and pulling arms; and devices with canted rolls with detents, each of which is discussed below.

FIGS. 2 and 3 illustrate a tubular nonwoven system 200 having a first type of puller device 2 ("Type A"), which includes a rotating screw 207 inside a tubular nonwoven 204. Such a device is illustrated, for example, in U.S. Pat. No. 5,366,576; U.S. Pat. No. 5,409,642; and U.S. Pat. No. 5,672,232.

A rotatable mandrel 202 functions as a collector surface for a melt-blowing die 201, which deposits molten fibers 203 onto the surface thereof. The rotatable mandrel 202 is driven at a first rotational speed $\Omega_1$ by a first motor "M". The first motor is connected to a first pulley 214 that is connected by a drive belt 213 to a second pulley 212, which is attached to the mandrel 202.

The rotatable screw 207 (having a slightly larger diameter than the outer diameter of the mandrel 202) is installed at the end of the mandrel 202. A shaft 208, which is positioned through the hollow mandrel 202, drives the screw 207 at a second rotational speed $\Omega_2$. The shaft 208 is turned at speed $\Omega_2$ by a third pulley 209, which is connected by a drive belt 211 to a fourth pulley 210. The fourth pulley 210 is operably connected to a second motor "M."

When the rotational speed $\Omega_2$ of the screw 207 is significantly (15% to 25%) faster than the rotational speed $\Omega_1$ of the mandrel 202, the screw thread cuts into the inner wall of the nonwoven tube 204 and pushes the tube 204 forward in an axial direction toward the cutting device 205. The cutting device 205 cuts the nonwoven tube 204 into tubular cartridges 206 of a desired length.

Although its mechanical system is complex and expensive, Type A pullers with inside screws (e.g., 2) are one of the most popular puller devices currently in use. One shortcoming associated with these types of puller devices 2 is that the rotating screw 207 cuts grooves into the inner wall of the nonwoven tube 204, and the resulting grooves may function as a continuous flow channel for filtrate and contaminants to escape under pressure. This concern is more serious when the flow pressure is high, the filtration requirement is stringent, or the filtrate is of high value.

Another limitation of Type A puller devices is the necessity to replace the complete set of the mandrel and screw each time a product change demands a different inner diameter. Such a requirement increases equipment and operational costs. All other types (discussed below) require only the mandrel to be replaced.

FIGS. 4 and 5 illustrate a tubular nonwoven system 300 having a second type of puller device 3 ("Type B"), which includes rotating screws 307 on the outside of the tubular nonwoven 304. Such a device is illustrated, for example, in U.S. Pat. No. 5,366,576 and U.S. Pat. No. 5,672,232.

A melt-blowing die 301 deposits molten fibers 303 onto a rotating mandrel 302 to form a continuous tubular nonwoven 304. The puller device 3 includes multiple (usually three) screws 307 that are positioned around and against the outer surface of the tubular nonwoven 304. An endless drive belt 309 engages the screws 307, and a pulley wheel 308 is connected to a motor "M". A drive belt tensioner 310 may be used to ensure the appropriate tension on the drive belt 309. The puller device 3 advances the nonwoven tube 304 to a cutting device 305, which cuts the tube into individual nonwoven cartridges 306 of a desired length. The surface speed of the screws 307 is faster than that of the nonwoven tube 304, pushing it in an axial direction toward the cutting blade 305.

The three puller screws 307 cut multiple grooves on the outer wall of the nonwoven cartridge 306. Except for detracting from the appearance of the product, the screws 307 result in less harm than the cuts on the inner wall that are produced by the Type A puller (the inner screw type) discussed above. However, this system's hardware and operation are more complicated and difficult to use than Type A.

FIGS. 6 and 7 illustrate a tubular nonwoven system 400 having a third type of puller device 4 ("Type C"), which includes multiple canted rollers 407 that are driven and that are pressed against a newly formed tubular nonwoven 404. Such a device is illustrated, for example, in U.S. Pat. No. 4,112,159; U.S. Pat. No. 4,116,738; and U.S. Pat. No. 5,591,335.

A melt-blowing die 401 deposits molten fibers 403 onto a rotating mandrel 402 to form the continuous tubular nonwoven 404. The rotatable mandrel 402 is driven at a first rotational speed $\Omega_1$ by a first motor "M". The puller device 4 includes multiple (usually three) canted rollers 407 that are positioned around and against the outer surface of the tube 404. The canted rollers 407 are driven by a second motor (not shown) at a second rotational speed $\Omega_2$. The nonwoven tube 404 is cut by a cutting device 405 into nonwoven cartridges 406 of a desired length.

By adjusting the angles between the axis of the mandrel and those of the canted rollers and by adjusting the speed differential between the surfaces of the tubular nonwoven and the canted rollers, an axial force component is produced that nudges the tube forward and off the mandrel, while the mandrel, the nonwoven tube, and the rollers are in rotational motion. It has been found that simultaneous adjustment of the angles, rotational speed, and compressive force of the rollers 407 is difficult to achieve and is impractical to automate by modern technology. As a result, although nonwoven manufacturers have used Type C puller devices commercially for the longest time, these manufacturers have found it hard to consistently obtain high product quality; and the off-quality ratio is high.

FIG. 8 illustrates a tubular nonwoven system 500 having a fourth type of puller device 5 ("Type D"), which includes gears 505 with puller arms 506. Such a device is illustrated, for example, in U.S. Pat. No. 4,847,125.

In this system 500, a melt-blowing die 501 deposits molten fibers 503 onto a rotating mandrel 502 to form a continuous tubular nonwoven 504. The rotatable mandrel 502 is driven by a first motor "M". When the nonwoven tube 504 reaches a desired diameter on the mandrel 502, a puller device engages the nonwoven tube.

The puller device 5 includes two gears 505, which are attached to puller arms 506 and which are positioned around and against the outer surface of the tube 504. The gears 505 are rotatable, but not motor-driven. The puller arms 506 pull the nonwoven tube 504 from the mandrel 502 in an axial direction 507, so that the nonwoven tube 504 may be subsequently cut by a cutting device (not shown) into nonwoven cartridges of a desired length.

The Type D puller device is complicated to operate and, thus, has limited practical utility. Because the puller device itself is located in an area previously used for the cutting device, this system is incapable of working in continuous production.

FIGS. 9 through 11 illustrate a tubular nonwoven system 600 having a fifth type of puller device 6 ("Type E"), which includes a large canted wheel 607 with detents that engage the outer surface of a tubular nonwoven 604. Such a device is illustrated, for example, in U.S. Pat. No. 6,736,274.

As with the previous melt-blowing systems, a melt-blowing die 601 deposits molten fibers 603 onto a rotating mandrel 602 to form a continuous nonwoven tube 604. The rotatable mandrel 602 is driven by a first motor "M". The canted wheel 607, which is driven by a second motor "M", includes multiple sharp detents on its outer periphery. The detents penetrate into the nonwoven tube 604 to pull the tube 604 from the mandrel 602 to a cutting device 605. The nonwoven tube 604 is cut by the cutting device 605 into nonwoven cartridges 606 of a desired length.

When the detents pierce the outer surface of the nonwoven tube 604, they pull the tube 604 in the direction of the rotational motion of the canted wheel 607. As a result, the detents leave permanent holes 608 in the outer surface of the nonwoven tube 604, which can impact the functionality of the nonwoven cartridge 606. Additionally, the pulling force of the canted wheel 607 may unwittingly cause rotational slippage between the nonwoven tube 604 and the mandrel 602.

Like the Type C puller device, the Type E puller device requires simultaneous adjustments to the speed, the slant angle, and the compression force of the canted wheel 607. Such multiple adjustments are difficult and imprecise. For this reason and because of the detent damage to the resulting product, these Type E systems have limited commercial applicability.

With these conventional puller devices, it has been observed that the forces of pull are imprecise and insufficient. When the puller devices engage the rotating nonwoven tube, they resist the tube's rotational motion with an undesirable and immeasurable torque, which often leads to inconsistency in product quality.

By using the performance criteria (a to i) listed above, the relative merits of each of the said types (A to E) are estimated below in TABLE 1. The requirements are rated on a scale of 1 to 10, where 1 is the least satisfactory and 10 is the most satisfactory.

TABLE 1

Performance characteristics of prior puller systems

| | Manufacturing Requirements (rated on scale of 1-10) 1 = least satisfactory, 10 = most satisfactory | | | | | | | | |
|---|---|---|---|---|---|---|---|---|---|
| Puller Type | a | b | c | d | e | f | g | h | i |
| A (inner screw) | 3 | 10 | 3 | 4 | 2 | 6 | 4 | 5 | 8 |
| B (outer screws) | 4 | 10 | 4 | 4 | 3 | 6 | 4 | 5 | 7 |
| C (canted rollers) | 2 | 10 | 4 | 3 | 5 | 4 | 4 | 3 | 3 |
| D (gears and arms) | 5 | 1 | 5 | 4 | 3 | 6 | 7 | 5 | 3 |
| E (canted roll with detents) | 5 | 10 | 6 | 4 | 1 | 8 | 3 | 8 | 5 |

As observed, none of the puller types scores highly in all requirements. From this background, it is clear that there remains a need for a better puller device and method.

SUMMARY

This disclosure is related to the manufacture of melt blown coreless tubular nonwovens. Such manufacture includes a melt blowing apparatus to deposit fibers onto a rotating mandrel for forming a tubular nonwoven; a puller device to steadily withdraw the tubular nonwoven from the mandrel; and a cutting device to cut the tubular nonwoven into cartridges of a desired length. The puller device has a pair of drive axles mounted on a gap-setting device, such as a scissor jack or its equivalent. Each drive axle includes one or more driven multi-directional puller wheels, which is formed of or surrounded by non-driven rollers. When the rollers engage the rotating tubular nonwoven, the tubular nonwoven is pulled axially and steadily from the mandrel without affecting the rotational motion of the tubular nonwoven. As a result, the tubular nonwovens have consistent dimensions and quality without damage to the inner or outer surfaces of the tube. Furthermore, the disclosed puller device is suitable to employ modern sensors and controllers to make processing more accurate and automatic. Other benefits include low cost, easy operation and maintenance, quick adaptation for product change, and reduced rejects.

According to one aspect, a system for producing tubular nonwovens is provided, the system comprising: a melt-blowing die for producing molten fibers; a rotating mandrel having a surface onto which the molten fibers are deposited to produce a continuous tubular nonwoven; a puller device downstream of the melt-blowing die, the puller device having a plurality of multi-directional rollers engaged with an outer surface of the tubular nonwoven, each of the multi-directional rollers being independently rotatable; and a cutting device for cutting the tubular nonwoven into a nonwoven cartridge.

In another aspect, a system for producing coreless nonwoven cartridges comprises: at least one melt-blowing die for producing molten fibers; a rotating mandrel having a surface onto which the molten fibers are deposited to produce a continuous tubular nonwoven; a puller device downstream of the melt-blowing die, the puller device having a plurality of multi-directional rollers engaged with an outer surface of the tubular nonwoven, each of the multi-directional rollers being operably connected to a hub and being independently rotatable; a radially adjustable gap-setting device to position the rollers against the tubular nonwoven; and a cutting device for cutting the tubular nonwoven into a nonwoven cartridge.

BRIEF DESCRIPTION OF THE DRAWINGS

A full and enabling disclosure of the present products and methods, including the best mode thereof, directed to one of ordinary skill in the art, is set forth in the specification, which makes reference to the appended figures, in which.

For convenience, their elements and reference numbers are listed in TABLE 2 below.

TABLE 2

Component List for Figures

Figure 1:
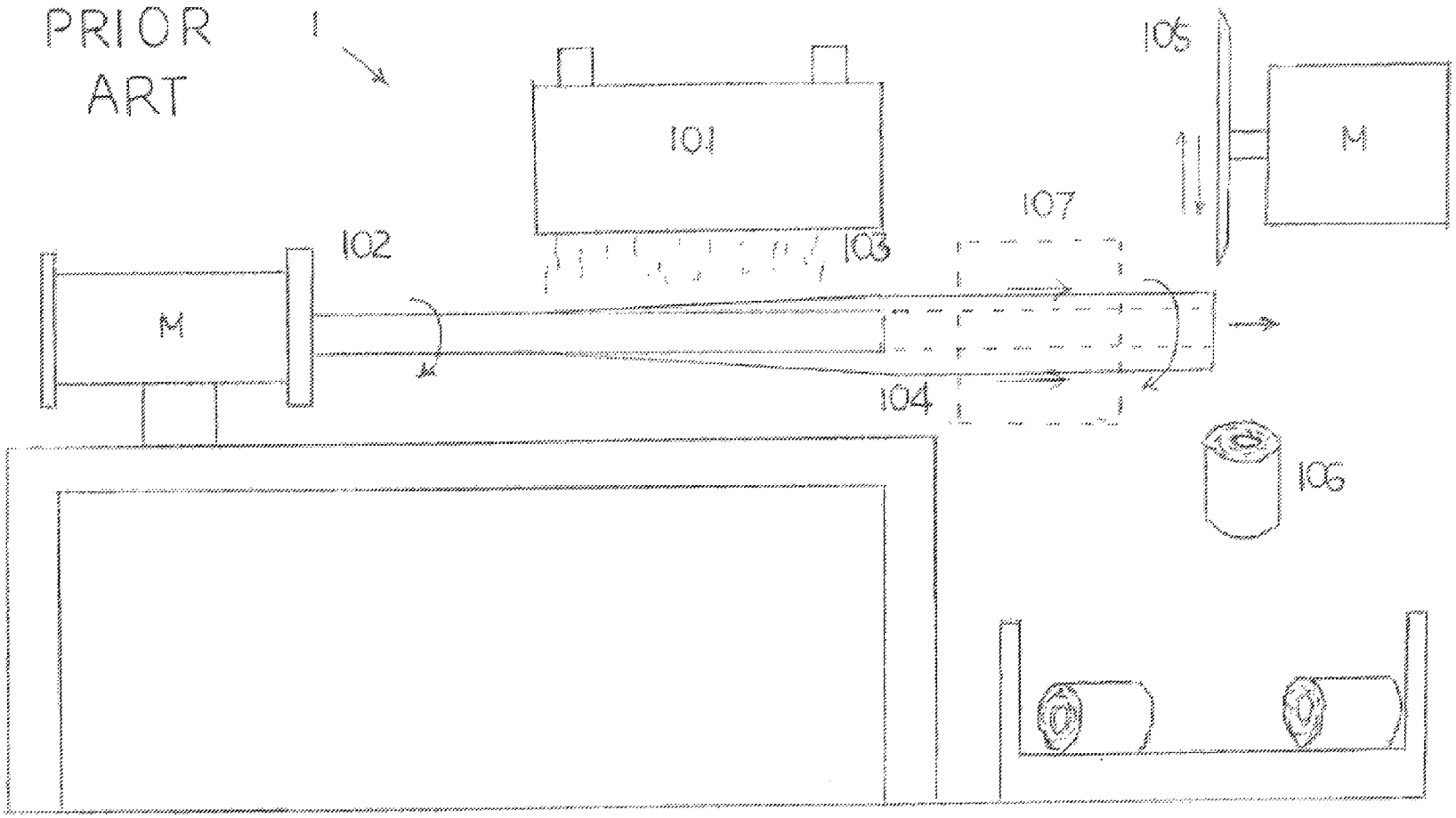
FIG. 1 PRIOR ART
FIG. 1 is a side view of a conventional system for producing a coreless melt-blown tubular cartridge.
Figure 2:
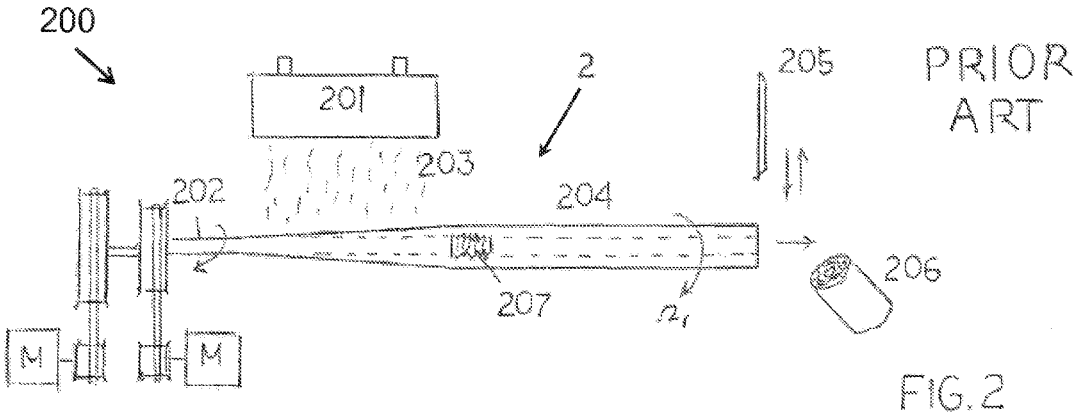
FIG. 2 is a side view of a conventional tubular nonwoven system having a traditional puller device (referred to herein as "Type A"), which uses an inside screw to advance the formed tube.
Figure 3:
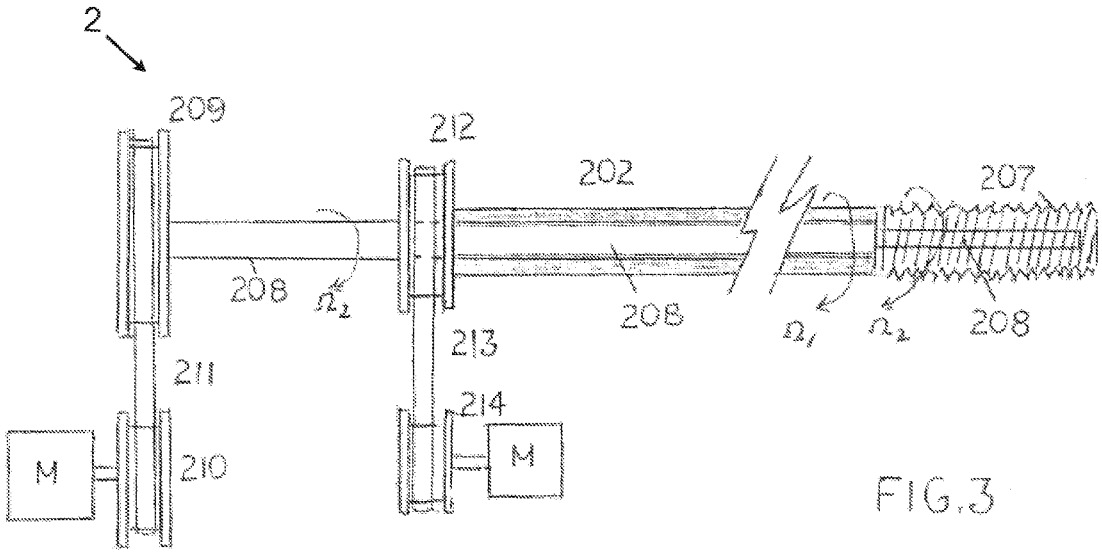
FIG. 3 PRIOR ART
FIG. 3 is a detailed side view of the Type A puller device of FIG. 2.
Figure 4:
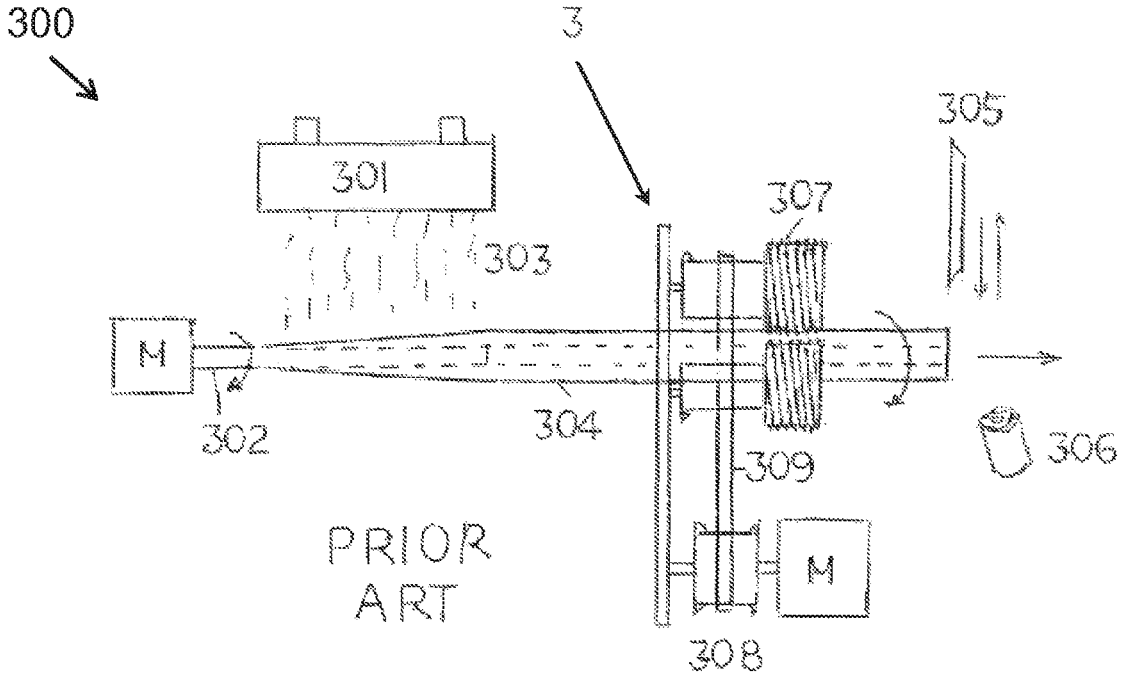
PRIOR ART FIG. 4
FIG. 4 is a side view of a conventional tubular nonwoven system having a traditional puller device (referred to herein as "Type B"), which uses three outside screws to advance the tube.
Figure 5:
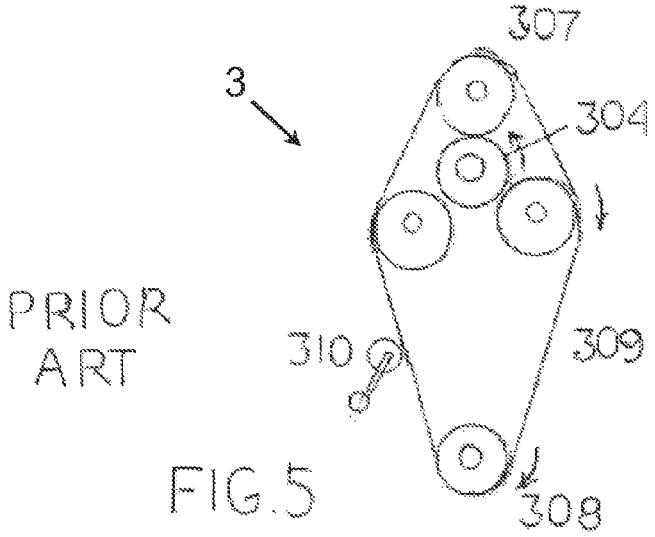
PRIOR ART FIG. 5
FIG. 5 is a cross-sectional view of the Type B puller device of FIG. 4.
Figure 6:
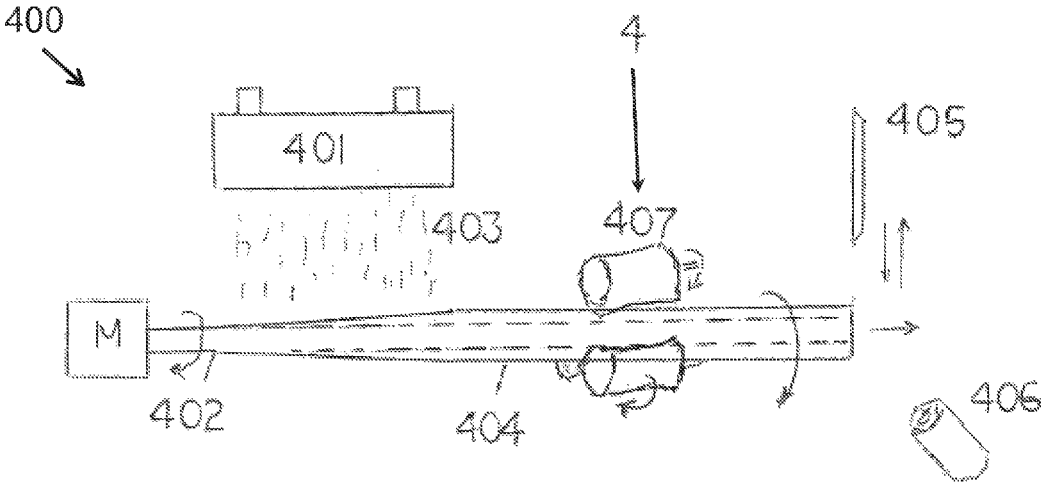
PRIOR ART FIG. 6
FIG. 6 is a side view of a conventional tubular nonwoven system having a traditional puller device (referred to herein as "Type C"), which uses three canted rollers to advance the tube.
Figure 7:
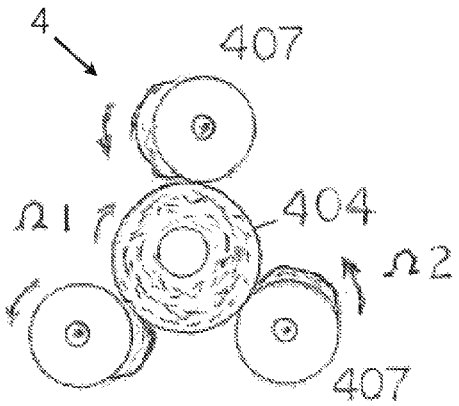
FIG. 7 PRIOR ART
FIG. 7 is a cross-sectional view of the Type C puller device of FIG. 6.
Figure 8:
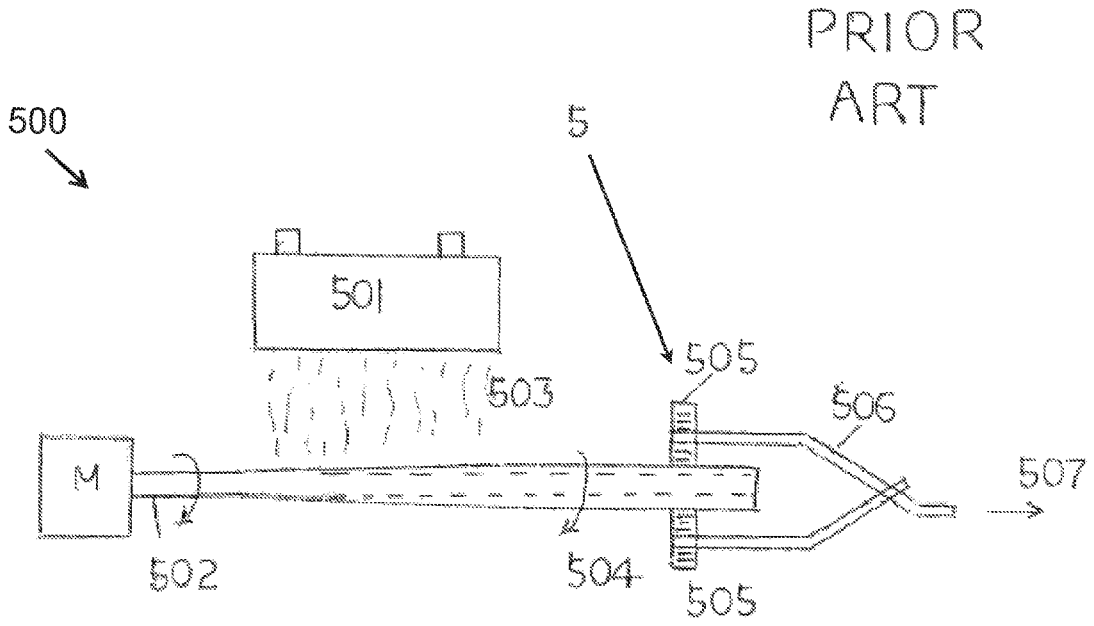
FIG. 8 is a side view of a conventional tubular nonwoven system having a traditional puller device (referred to herein as "Type D"), which uses gears and attached arms to advance the tube.
Figure 9:
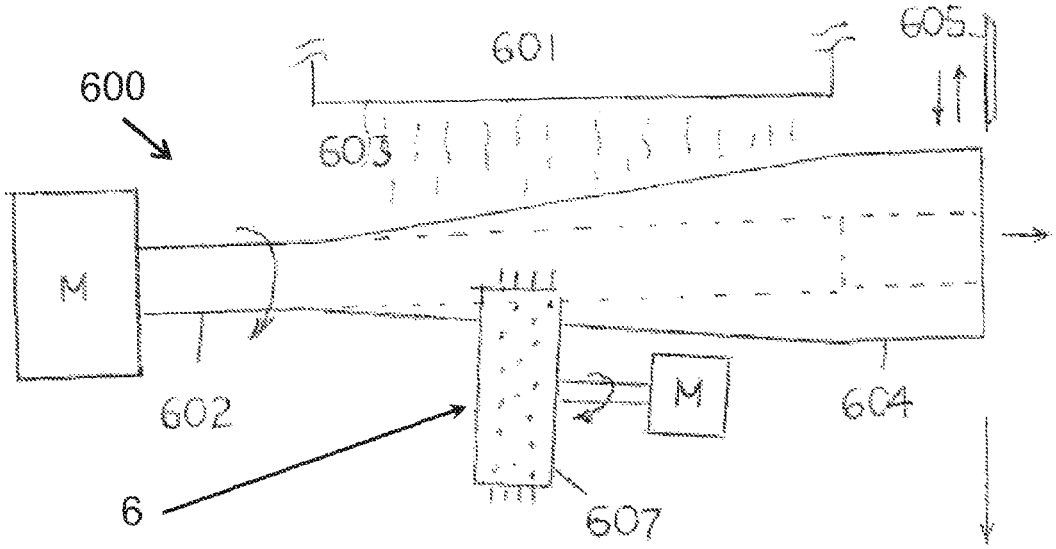
FIG. 9 PRIOR ART
FIG. 9 is a side view of a conventional tubular nonwoven system having a traditional puller device (referred to herein as "Type E"), which uses a large canted roll with detents to advance the tube.
Figure 10:
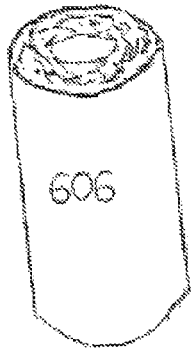
FIG. 10 is a cross-sectional view of the Type E puller device of FIG. 9.
Figure 10:
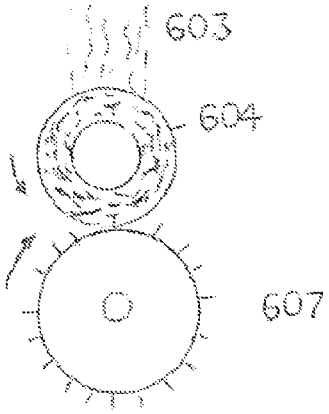
Figure 11:
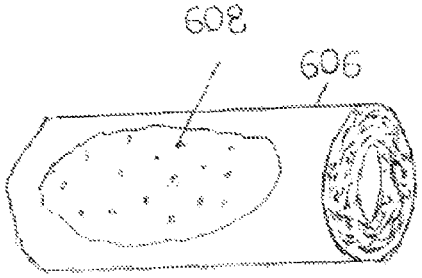
FIG. 11 is a side view of a nonwoven cartridge produced by the apparatus of FIGS. 9 and 10, which illustrates damage on the cartridge surface caused by the detents.

| | | | |
|---|---|---|---|
| FIG. 1 | | | |
| 1 | tubular nonwoven system | 104 | tubular nonwoven |
| 101 | melt-blowing die | 105 | cutting device |
| 102 | rotating mandrel | 106 | nonwoven cartridge |
| 103 | molten fibers | 107 | puller device |
| FIGS. 2 and 3 (Type A puller device) | | | |
| 2 | puller device of Type A | 207 | screw |
| 200 | tubular nonwoven system | 208 | rotatable shaft |
| 201 | melt-blowing die | 209 | pulley |
| 202 | rotating mandrel | 210 | pulley |
| 203 | molten fibers | 211 | drive belt |
| 204 | tubular nonwoven | 212 | pulley |
| 205 | cutting device | 213 | drive belt |
| 206 | nonwoven cartridge | 214 | pulley |
| FIGS. 4 and 5 (Type B puller device) | | | |
| 3 | puller device of Type B | 305 | cutting device |
| 300 | tubular nonwoven system | 306 | nonwoven cartridge |
| 301 | melt-blowing die | 307 | rotating screws |
| 302 | rotating mandrel | 308 | pulley |
| 303 | molten fibers | 309 | drive belt |
| 304 | tubular nonwoven | 310 | drive belt tensioner |
| FIGS. 6 and 7 (Type C puller device) | | | |
| 4 | puller device of Type C | 404 | tubular nonwoven |
| 400 | tubular nonwoven system | 405 | cutting device |
| 401 | melt-blowing die | 406 | nonwoven cartridge |
| 402 | rotating mandrel | 407 | canted rollers |
| 403 | molten fibers | | |
| FIG. 8 (Type D puller device) | | | |
| 5 | puller device of Type D | 504 | tubular nonwoven |
| 500 | tubular nonwoven system | 505 | gears |
| 501 | melt-blowing die | 506 | puller arms |
| 502 | rotating mandrel | 507 | direction of pulling force |
| 503 | molten fibers | | |
| FIGS. 9, 10, 11 (Type E puller device) | | | |
| 6 | puller device of Type E | 604 | tubular nonwoven |
| 600 | tubular nonwoven system | 605 | cutting device |
| 601 | melt-blowing die | 606 | nonwoven cartridge |
| 602 | rotating mandrel | 607 | canted roll with detents |
| 603 | molten fibers | 608 | perforations caused by detents |
| FIGS. 12 through 18 (Type F puller device of present disclosure) | | | |
| 7 | puller device of Type F | 708 | multi-directional wheel |
| 700 | tubular nonwoven system | 709 | roller in wheel 708 |
| 701 | melt-blowing die | 710 | axle of wheel 708 |
| 702 | rotating mandrel | 711 | hub of wheel 708 |
| 703 | molten fibers | 712 | alternate multi-directional wheel |
| 704 | tubular nonwoven | 713 | roller in wheel 712 |
| 705 | cutting device | 714 | anchor for roller 713 |
| 706 | nonwoven cartridge | 715 | puller arm |
| 707 | gap-setting device (e.g., scissor jack) | | |

DETAILED DESCRIPTION

Reference will now be made in detail to embodiments of the inventive products and methods, one or more examples of which are illustrated in the drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components.

Each example is provided by way of explanation of the invention, not limitation of the invention. In fact, it will be apparent to one of ordinary skill in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as fall within the scope of the appended claims and their equivalents.

This disclosure is directed to a system for the continuous production of the coreless melt blown (MB) tubular cartridges, which are suitable for use as filter media.

Equipment and processes for making coreless nonwoven tubes are described in the Background section of the present disclosure and in the patents referenced herein. The conventional types of puller devices (Types A to E), along with their advantages and disadvantages (Table 1), are also discussed in the Background section with reference to FIGS. 2 to 11.

The performance of the puller device impacts process efficiency and product quality in many ways. Its performance should at least meet these requirements: (1) the puller device should grip the rotating tubular nonwoven firmly without slippage; (2) through the grip, a firm force of pull in an axial direction should be applied to the tubular nonwoven; (3) neither the grip or the force of pull should interfere with the rotation of the tubular nonwoven; (4) the forces of grip and of pull should be separately measurable and controllable; and (5) these forces should not cause damage or lasting deformation to the inner and outer peripheries of the resulting product. Only the presently disclosed puller devices are capable of meeting all these requirements, while none of the state-of-the-art types (types A through E) have such capability.

Other benefits of the disclosure include simplicity of equipment and operation, low cost, easy-to-apply automation, less waste, and better product quality.

Figure 12:
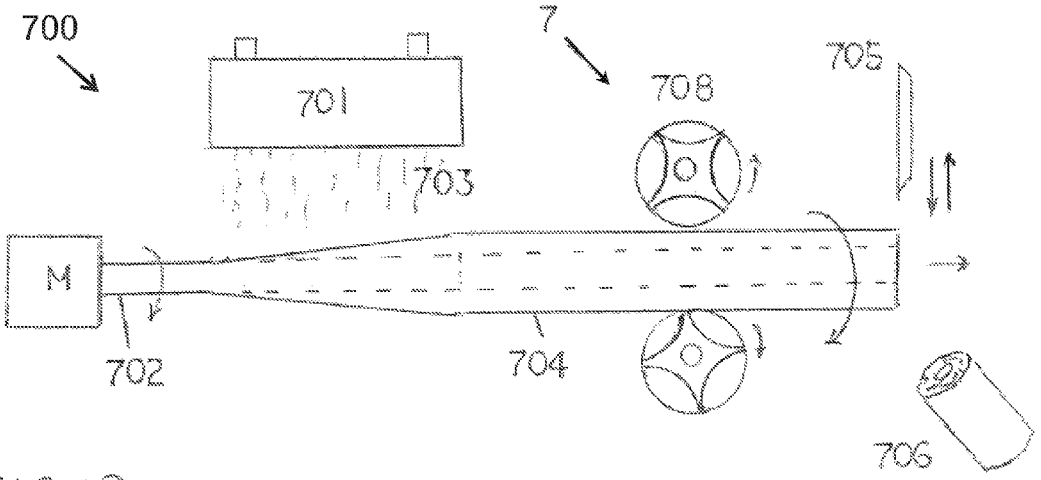
FIG. 12 is a side view of a tubular nonwoven system with a puller device of the present disclosure (referred to herein as "Type F"), using adjustable puller arms with multi-directional wheels.
Figure 13:
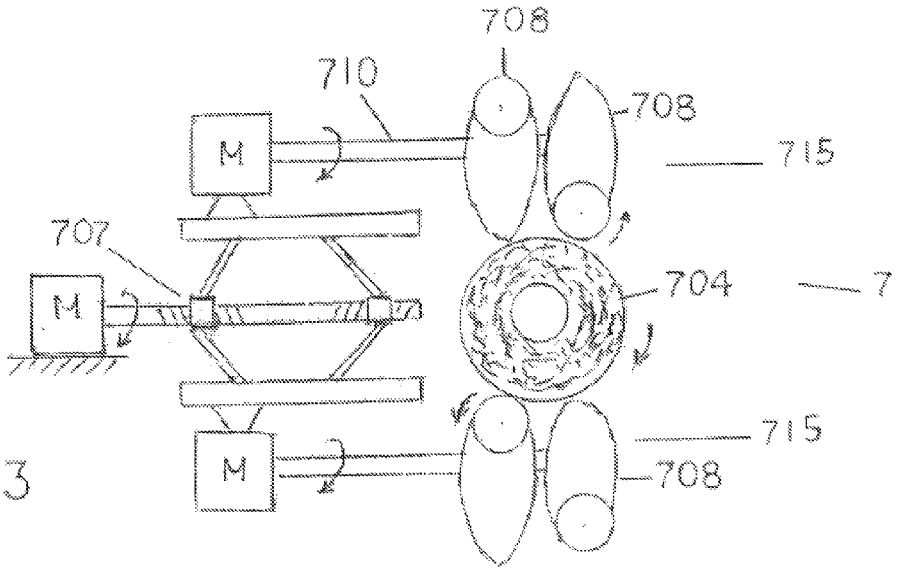
FIG. 13 is a cross-sectional view of the Type F puller device of FIG. 12.

FIGS. 12 and 13 illustrate a system 700 for the production of coreless nonwoven cartridges, according to a first aspect of the present disclosure. A melt-blowing die 701 deposits molten fibers 703 onto a mandrel 702, which is rotated by a motor "M". As the fibers 703 are deposited onto the rotating mandrel 702, a tubular nonwoven 704 is created. The tubular nonwoven is drawn downstream from the melt-blowing die 701 by a puller device 7 and is cut into individual nonwoven cartridges 706 by a cutting device 705.

The puller device 7 of the present disclosure, which is located downstream from the melt-blowing die 701, includes two puller arms 715 for gripping and pulling the nonwoven tube 704. Each arm 715 has two multi-directional puller wheels 708 mounted on an axle 710, which is operably connected to a drive motor "M". The arms 715 are mounted in parallel on a gap-setting device 707 (such as a scissor jack or equivalent structure), so that the distance between the arms 715 can be varied to accommodate tubular nonwovens 704 of different diameters. The gap-setting device 707 can also control the grip force applied on the tube 704.

Independently, the speed control of the wheels 708 determines the speed of pull and the resulting outer diameter of the nonwoven tube 704. When the manufacturer desires to produce a nonwoven tube 704 with a small outer diameter, the pull speed of the wheels 708 may be set to a relatively fast speed. Conversely, when the manufacturer desires to produce a nonwoven tube 704 with a larger outer diameter, the pull speed of the wheels 708 is slowed. To accommodate different outer diameters, the drive motor on the gap-setting device 707 may be adjusted to maintain the appropriate contact between the nonwoven tube 704 and the wheels 708.

The wheels 708 do not impede the rotational motion of the nonwoven tube 704, even when the wheels 708 are pressed tightly against the nonwoven tube 704, nor do the wheels 708 damage the exterior surface of the nonwoven tube 704. Even though a single multi-directional wheel 708 on each puller arm 715 may be able to engage and pull the nonwoven tube 704, two wheels 708 on each arm 715 (as shown in FIG. 13) may afford a safer accommodation for the rotating tube 704.

Figure 14:
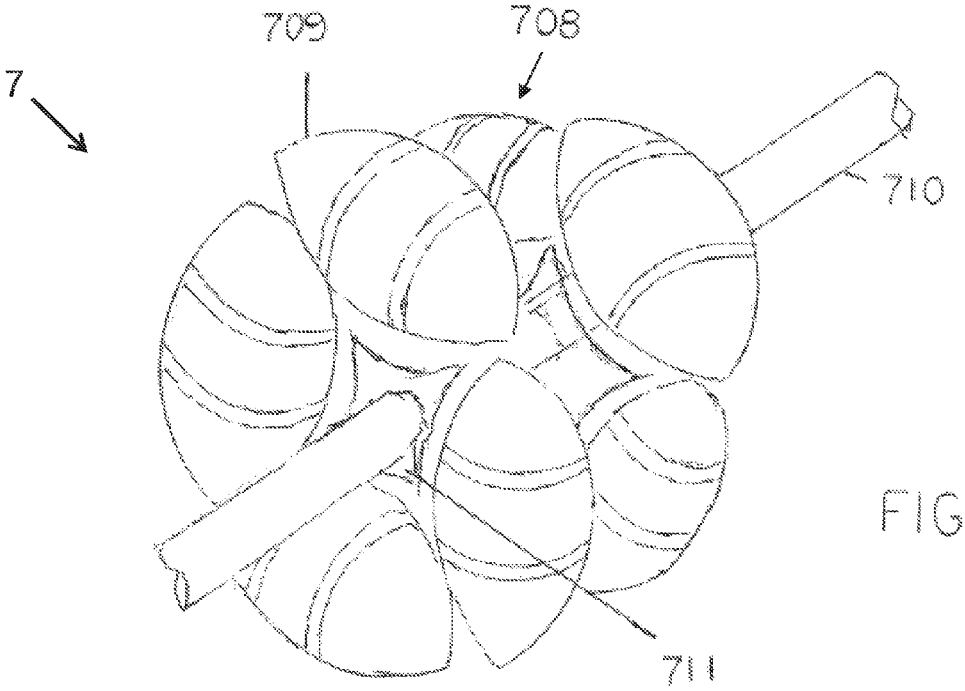
FIG. 14 is a perspective view of the multi-directional wheel, used in the Type F puller device of FIG. 12.

FIG. 14 illustrates the puller wheels 708 on one of the puller arms 715. The puller wheels 708 include four rollers 709, each of which is shaped as a prolate spheroid that rotates about its own major (longitudinal) axis. The structural details of the wheel 708 and the rollers 709 are shown in FIG. 15.

Figure 15:
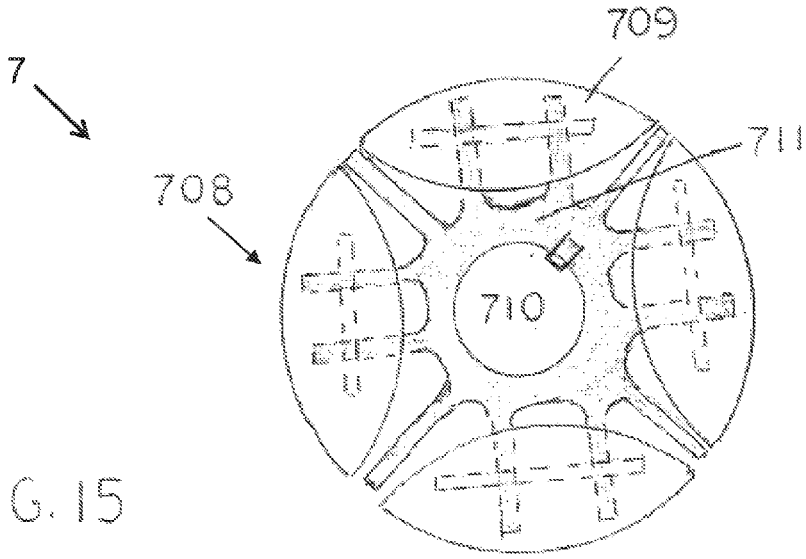
FIG. 15 is a cross-sectional view of the multi-directional wheel of FIG. 14.

As shown in FIG. 15, the drive axle 710 of the puller arm wheels 708 is surrounded by a multi-spoke hub 711. The hub 711 and the axle 710 may be secured by a key or tab. Each roller 709 rotates around a rod (shown in dashed lines) that is positioned through a pair of adjacent spokes in the hub 711. Since each roller 709 has its own axis of rotation (i.e., about the rod), each roller 709 can rotate independently of the other rollers 709, while the collective profile of the rollers 709 produces a wheel or circular shape conducive for engaging the tubular nonwoven 704. The rollers 709 may be made of, or covered with, a semi-hard material to avoid slippages and scratches on the tubular nonwoven 704. Providing grooves in the roller surface (as shown in FIG. 14) or roughing up the surface of the roller can also improve traction.

Figure 16:
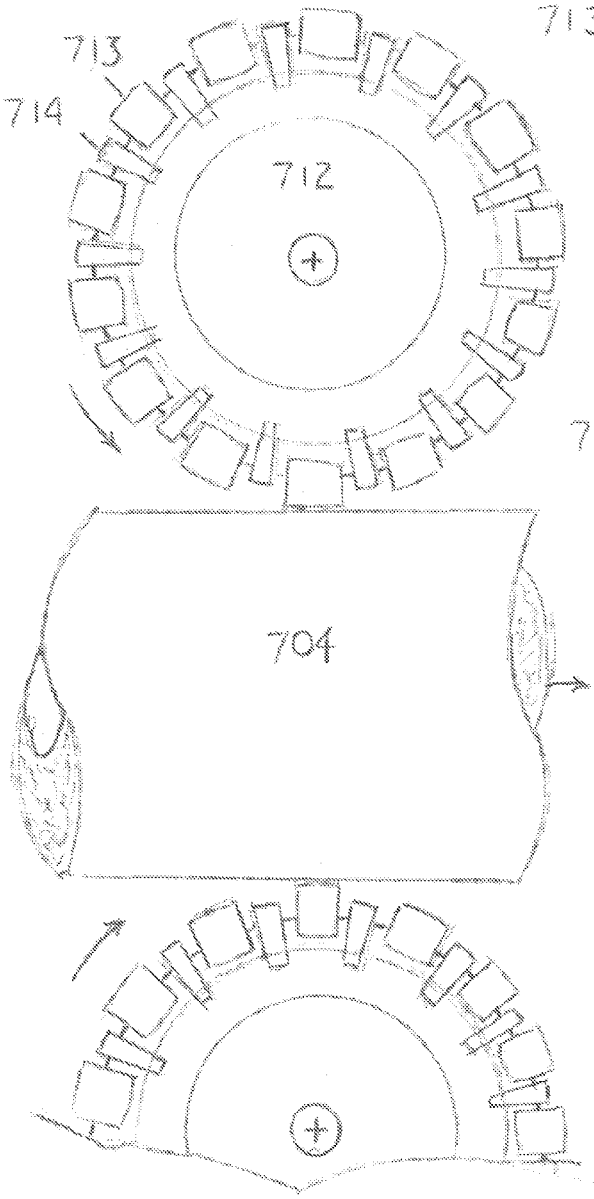
FIG. 16 is a plan view of an alternate design of the multi-directional wheel of FIG. 14.
Figure 17:
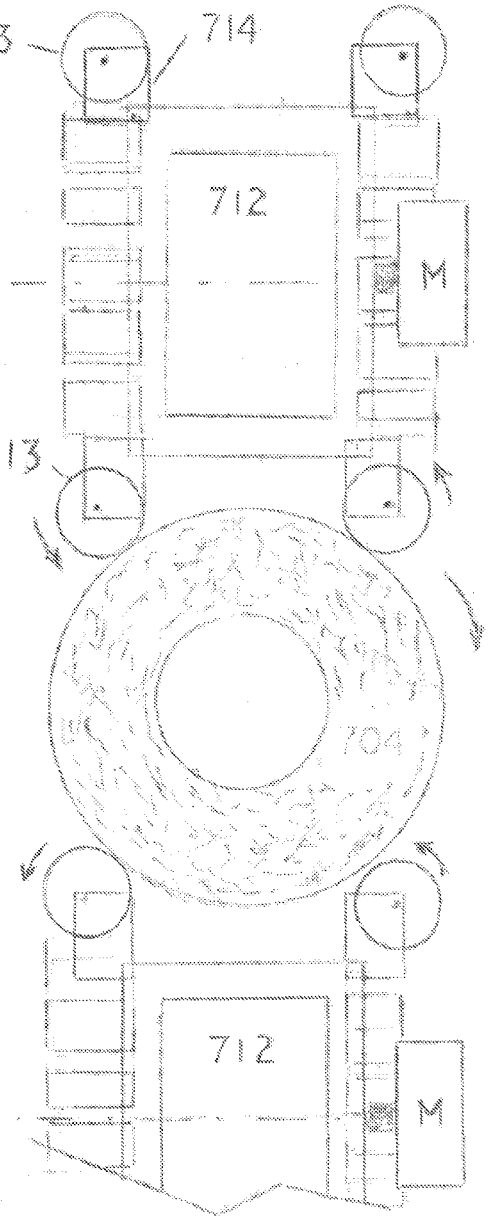
FIG. 17 is a cross-sectional view of the alternate multi-directional wheel of FIG. 16.
Figure 18:
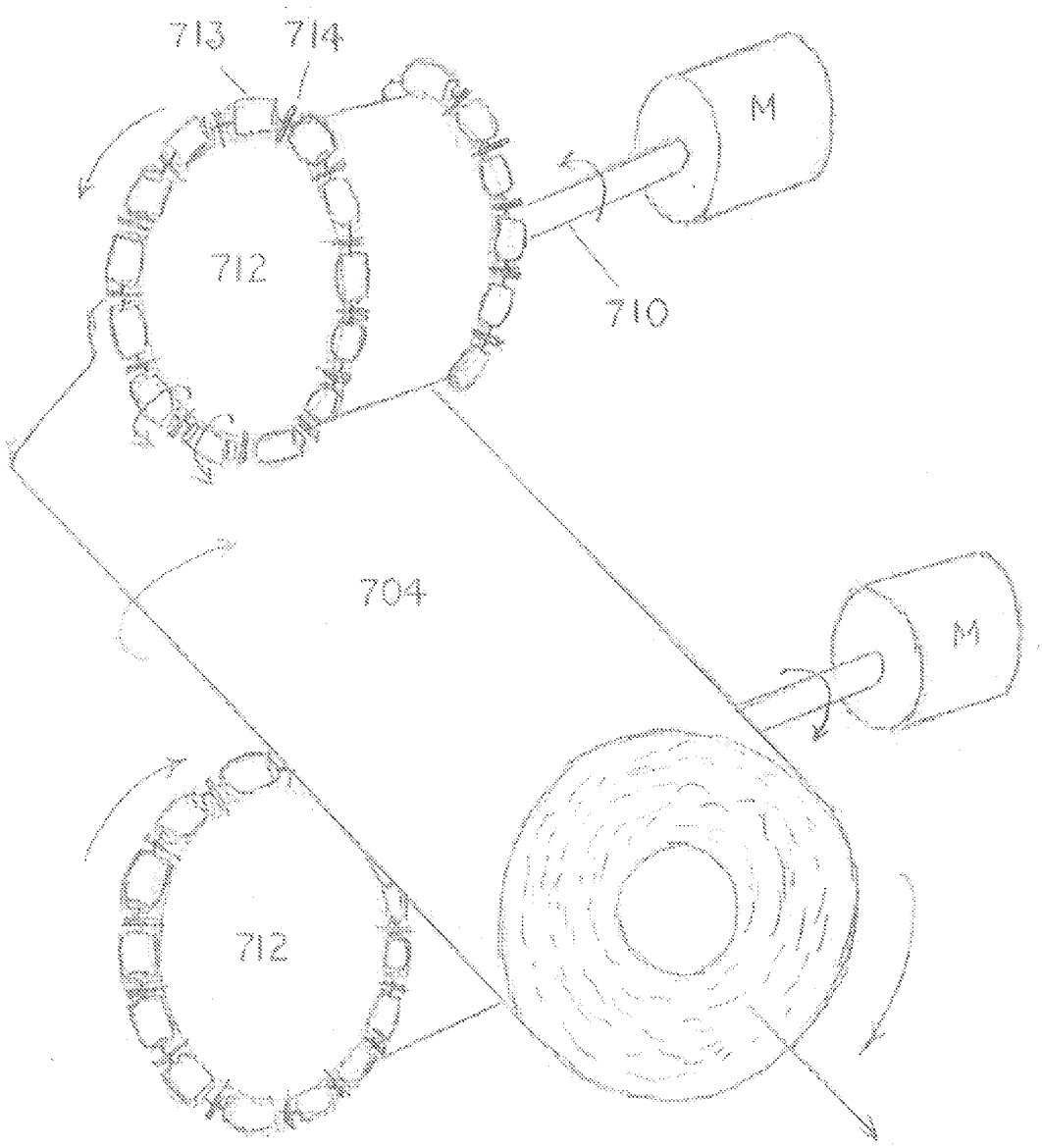
FIG. 18 is a perspective view of the alternate multi-directional wheel of FIGS. 16 and 17.

FIGS. 16, 17, and 18 illustrate alternate multi-directional wheel assemblies 712 that can be used as the puller assembly 7 in the present melt-blowing system. The puller device with these multi-directional wheel assemblies 712 performs as well as the puller wheel 708 (shown in FIGS. 14 and 15). In this puller device, each of the two multi-directional wheel assemblies has a center axle 712 surrounded by a plurality of passive rollers 713, each of which has a cylindrical shape. The passive rollers 713 are arranged in two parallel, axially separated planes. Each center axle 712 is driven by a motor "M". Each of the plurality of rollers 713 is mounted on two roller anchors 714. Each roller 713 can rotate separately from the other rollers 713 as a result of its contact with the tubular nonwoven 704 (in other words, the rollers 713 themselves are not driven).

The tubular nonwoven 704 has four points of contact with the respective rollers 713, two of which are associated with an upper multi-directional wheel assembly and a two of which are associated with a lower multi-directional wheel assembly. The multiple points of contact help to ensure the uniform and symmetrical shape of the nonwoven cartridge 704. As the center axle 712 of each wheel assembly is driven by the motor, the contact between the rollers 713 and the nonwoven tube 704 pulls the tubular nonwoven 704 in an axial direction toward a cutting blade (not shown). The rotation of the rollers 713 is counter to the rotation of the tubular nonwoven 704, as shown in FIGS. 17 and 18, and is designed to absorb the rotational movement of the tubular nonwoven 704.

Puller wheels 708 and 712 are design examples used for teaching the essence of present disclosure and should not be construed as limiting the invention. The gap-setting device 707 is also exemplary and not intended to limit the invention to a particular structure. From the teachings of this disclosure, those with ordinary skill in the art may well identify additional configurations or modifications for wheels 708 and 712 and the gap-setting device 707. Such extensions are intended to fall within the spirit of the present invention and its claims.

Finally, modern sensors and controllers can be employed with reasonable simplicity to make the present puller assembly 7 more dependable and self-controllable. For instance, non-contact sensors can measure the outer diameter and the axial speed of the tubular nonwoven. A piezoelectric sensor (not shown) can measure the compression force between the puller wheel and the tubular nonwoven. Alternately or additionally, an optical sensor may be used. Alarms and E-stops may be employed to reduce labor and waste. A process controller (PC) may use these signals to operate the puller device on a "cruise-control" mode.

The present puller devices are simple and economical. Further, they meet all the performance requirements (a to i) described in the Background section. TABLE 3 shows a comparison of the present puller device (Type F) with the prior-art types of puller devices (Types A to E, as described above). Again, the requirements are rated on a scale of 1 to 10, where 1 is the least satisfactory and 10 is the most satisfactory.

TABLE 3

Performance characteristics of prior puller systems compared to the present puller device

| | Manufacturing Requirements (rated on scale of 1-10) 1 = least satisfactory, 10 = most satisfactory | | | | | | | | |
|---|---|---|---|---|---|---|---|---|---|
| Puller Type | a | b | c | d | e | f | g | h | i |
| A (inner screw) | 3 | 10 | 3 | 4 | 2 | 6 | 4 | 5 | 8 |
| B (outer screws) | 4 | 10 | 4 | 4 | 3 | 6 | 4 | 5 | 7 |
| C (canted rollers) | 2 | 10 | 4 | 3 | 5 | 4 | 4 | 3 | 3 |
| D (gears and arms) | 5 | 1 | 5 | 4 | 3 | 6 | 7 | 5 | 3 |
| E (canted roll with detents) | 5 | 10 | 6 | 4 | 1 | 8 | 3 | 8 | 5 |
| F (present device with multi-directional rollers) | 8 | 10 | 8 | 9 | 8 | 9 | 8 | 9 | 10 |

Specifically, the present puller devices facilitate the production of nonwoven cartridges of uniform dimension and without damage to the inner or outer surfaces of the cartridge. In addition, the present puller devices permit manufacturers to rapidly change the outer diameter of the nonwoven tube without replacing the mandrel or making cumbersome adjustments to the puller device. For these reasons, the present puller devices as described herein are believed to be advancements over the state of the art.

While the present embodiments are illustrated as being produced with a single melt-blowing apparatus, it should be understood that multiple melt-blowing apparatuses may be used in the production of a multi-layered product and that the layers of the product may be of different polymer types or sizes. Such systems are described in co-pending and concurrently filed U.S. patent application Ser. No. 14/614,277, entitled "Heterogeneous Melt-Blown Nonwovens and Die Tips Used in Production Thereof," the disclosure of which is hereby incorporated by reference.

This written description uses examples to disclose the invention, including the best mode, and also to enable any person skilled in the art to practice the invention, including making and using any devices or systems and performing any incorporated methods. The patentable scope of the invention is defined by the claims, and may include other variations that occur to those skilled in the art. Such other variations are intended to fall within the scope of the claims if they include structural elements that do not differ from the literal language of the claims, or if they include equivalent structural elements with insubstantial differences from the literal language of the claims.

What is claimed is:

1. A system for producing tubular nonwovens, the system comprising:

a melt-blowing die for producing molten fibers;

a rotating mandrel having a surface onto which the molten fibers are deposited to produce a continuous tubular nonwoven;

a puller device downstream of the melt-blowing die, the puller device having an upper wheel assembly and a lower wheel assembly, each of the upper wheel assembly and the lower wheel assembly including a plurality of multi-directional rollers engageable with an outer surface of the tubular nonwoven, each of the multi-directional rollers being independently rotatable; and a cutting device for cutting the tubular nonwoven into a nonwoven cartridge.

2. The system of claim 1, further comprising a first motor operably connected to the rotating mandrel, the first motor setting the rotational speed of the mandrel.

3. The system of claim 2, wherein the puller device further comprises a pair of drive axles, each drive axle being perpendicular to a longitudinal axis of the mandrel and being surrounded by a central hub; wherein the central hub comprises a plurality of spokes extending radially from the central hub; and wherein a transverse rod positioned through adjacent spokes supports one of the multi-directional rollers.

4. The system of claim 3, wherein each of the multi-directional rollers has a shape of a prolate spheroid; and wherein the transverse rod is positioned through a longitudinal axis of the prolate spheroid.

5. The system of claim 3, further comprising a gap-setting device for adjusting the radial position of the multi-directional rollers; and wherein each drive axle is connected to a second drive motor, the second drive motors being mounted on platforms on the gap-setting device.

6. The system of claim 5, wherein the second drive motors set the rate at which the tubular nonwoven is withdrawn from the mandrel.

7. The system of claim 5, wherein the gap-setting device comprises a scissor jack and a third drive motor; and wherein the third drive motor adjusts the position of the drive axles.

8. A system for producing tubular nonwovens, the system comprising:

a melt-blowing die for producing molten fibers;

a rotating mandrel having a surface onto which the molten fibers are deposited to produce a continuous tubular nonwoven;

a puller device downstream of the melt-blowing die, the puller device comprising an upper wheel assembly and a lower wheel assembly, each wheel assembly having a central axle surrounded by a plurality of roller anchors radially extending from the central axle and a plurality of multi-directional, cylindrical rollers engaged with an outer surface of the tubular nonwoven, each of the multi-directional rollers being independently rotatable and each roller being mounted on at least one of the plurality of roller anchors; and a cutting device for cutting the tubular nonwoven into a nonwoven cartridge.

9. The system of claim 8, wherein each central axle has a circumferential profile; and wherein an alternating pattern of rollers and roller anchors surrounds the central axle.

10. The system of claim 1, wherein the multi-directional rollers comprise a grooved or roughened surface.

11. The system of claim 1, wherein the cutting device is a knife or saw.

12. A system for producing coreless nonwoven cartridges, the system comprising:

at least one melt-blowing die for producing molten fibers;

a rotating mandrel having a surface onto which the molten fibers are deposited to produce a continuous tubular nonwoven;

a puller device downstream of the melt-blowing die, the puller device comprising an upper wheel assembly and a lower wheel assembly, each wheel assembly having a plurality of multi-directional rollers engageable with an outer surface of the tubular nonwoven, each of the multi-directional rollers being operably connected to a hub and being independently rotatable;

a radially adjustable gap-setting device to position the rollers against the tubular nonwoven; and a cutting device for cutting the tubular nonwoven into a nonwoven cartridge.

13. The system of claim 12, wherein the multi-directional rollers are positioned on a drive axle, the drive axle being operably connected to a drive motor; and wherein the drive motor sets a speed at which the tubular nonwoven is withdrawn from the mandrel.

14. The system of claim 13, wherein the gap-setting device comprises a platform, and wherein the drive motor is mounted to the platform of the gap-setting device.

15. The system of claim 12, wherein the multi-directional rollers comprise a grooved or roughened surface, the grooved or roughened surface allowing the tubular nonwoven to be pulled without rotational slippage between the tubular nonwoven and the mandrel.

16. The system of claim 15, wherein the multi-directional rollers comprise an outer surface that engages the tubular nonwoven without damaging an inner surface or an outer surface of the tubular nonwoven.

17. The system of claim 12, wherein the multi-directional rollers pull the tubular nonwoven in a substantially axial direction without imparting a peripheral torque to the tubular nonwoven.

* * * * *